United States Patent [19]

Emrick

[11] 3,999,492

[45] Dec. 28, 1976

[54] LOCKING DEVICE FOR OVER-BED TABLE

[75] Inventor: Homer R. Emrick, Kalamazoo, Mich.

[73] Assignee: Emrick, Inc., Kalamazoo, Mich.

[22] Filed: June 20, 1975

[21] Appl. No.: 588,867

[52] U.S. Cl. ..... 108/144; 108/146; 248/411

[51] Int. Cl.[2] ..... A47B 9/00

[58] Field of Search ..... 108/146, 136, 144; 248/162, 411, 412, 408, 409, 410

[56] References Cited

UNITED STATES PATENTS

| | | | |
|---|---|---|---|
| 389,577 | 9/1888 | Kintz | 248/410 |
| 2,609,033 | 9/1952 | Finke | 108/146 |
| 2,787,485 | 4/1957 | Frisell | 248/412 X |
| 3,188,986 | 6/1965 | La Vigne | 108/136 |
| 3,310,008 | 3/1967 | Aleksa et al. | 108/146 |
| 3,380,405 | 4/1968 | Barecki et al. | 108/146 X |
| 3,715,997 | 2/1973 | Barth | 108/146 |
| 3,854,428 | 12/1974 | Fullenkamp | 108/146 |

*Primary Examiner*—Roy D. Frazier
*Assistant Examiner*—Peter A. Aschenbrenner
*Attorney, Agent, or Firm*—Woodhams, Blanchard and Flynn

[57] ABSTRACT

A bedside table for use over a bed or like object. The table has a base and a vertical guide thereon. A table top having a support thereon is adapted to cooperate with the vertical guide on the base to maintain the table top horizontal as its vertical position is varied over a range. A constant force spring is connected between the base and the table top to apply a constant force tending to raise the table top over the range. Releasable locking means are provided to lock the table top at any vertical position within the range. The locking device includes a vertical surface and a pivotally mounted cam secured to move into and out of engagement with the vertical surface. A spring is provided for continuously urging the cam toward engagement with the vertical surface. The spacing between the pivot axis for the cam and the vertical surface is less than the length of the cam between the pivot axis and the free end of the cam. The cam is to become tightly wedged between the pivot axis and the vertical surface upon a downward force being applied to the table top to lock the table top in a desired vertical position in its range of movement. This camming action also causes the looseness between the table top and the vertical guide to become tightened. A release device is provided for moving the cam downwardly away from the vertical surface and out of engagement with the vertical surface against the urging of the spring to facilitate a vertical adjustment of the table top.

5 Claims, 5 Drawing Figures

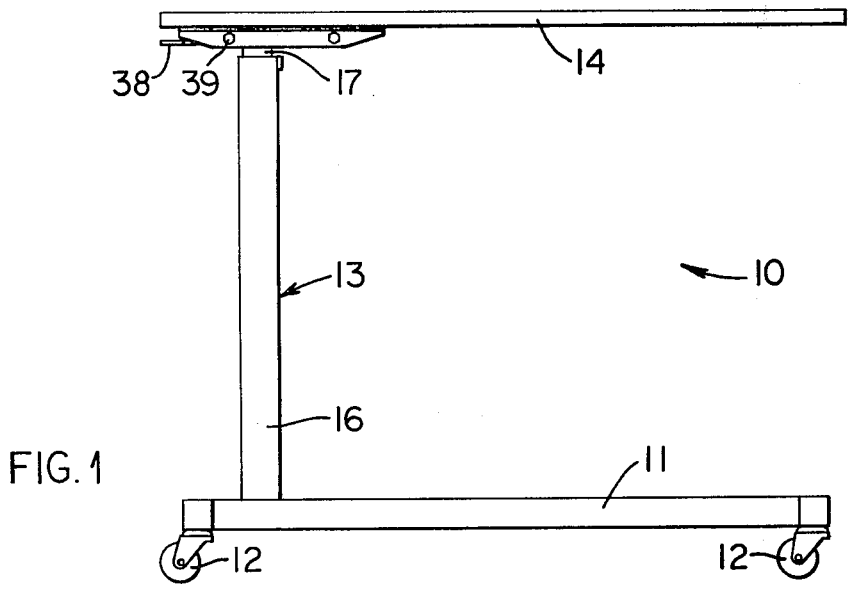
FIG. 1
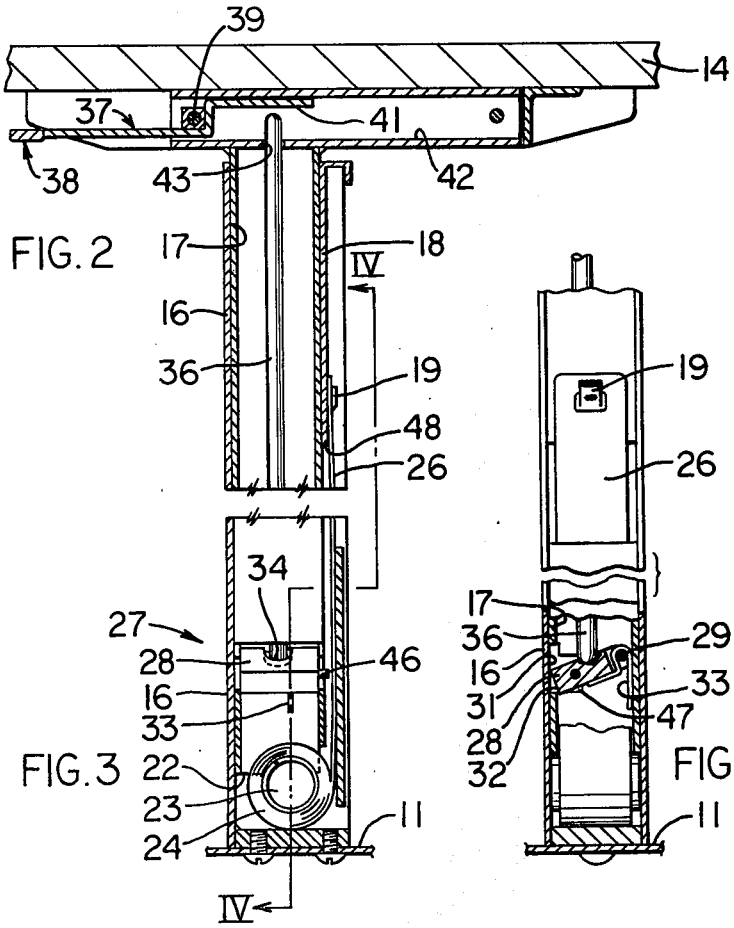
FIG. 2
FIG. 3
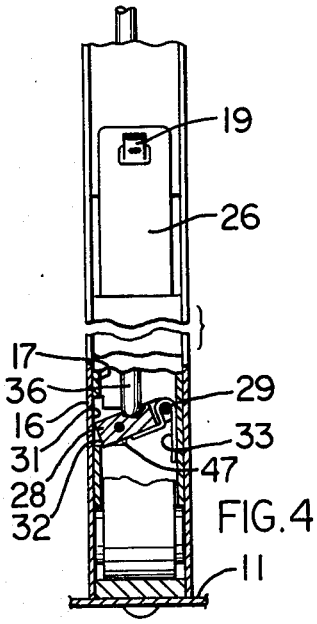
FIG. 4
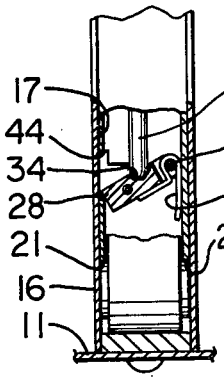
FIG. 5

LOCKING DEVICE FOR OVER-BED TABLE

FIELD OF THE INVENTION

This invention relates to a bedside table and, more particularly, relates to an improvement in a locking structure for locking the table top in any vertical position throughout its range of movement.

BACKGROUND OF THE INVENTION

Bedside tables which may be raised and lowered have been utilized in hospitals and similar situations in which it is desirable to have a table which may be utilized by a person in a bed or a chair. Such bedside tables have been conventionally constructed of a base having an upright structure at one end and a table top with a supporting structure at one end which cooperates with the upright portion of the base to support the table top. A spring which aids the raising of the table top is connected between the top and the base. There is, however, some normal clearance between the telescoping vertical guide post assembly and this causes an unsteady table top. An improved locking structure for locking the table top in any desired vertical position relative to the base over its range is highly desirable. It is also highly desirable to provide a steady table top.

It is, therefore, an object of the present invention to provide a new and improved locking device for a bedside table which simultaneously renders the table top steady.

Another object of the present invention is to provide a locking device which is inexpensive to manufacture, simple to assemble and easily maintained in satisfactory operating condition.

SUMMARY OF THE INVENTION

In general, the objects and purposes of the invention are met by providing a bedside table comprising base means including vertical guide means thereon and a table top having support means thereon adapted to cooperate with the vertical guide means to maintain the table top horizontal as its vertical position is varied over a range. A constant force spring is connected between the base means and the table top to apply a constant force tending to raise the table top over the range. Releasable locking means are adapted to operate between the table top and the base means to lock the table top at any vertical position within the range. The locking means includes means defining a vertical surface secured either to the table top or the vertical guide means. A cam is pivotally secured to the opposite one of the table top and the vertical guide for movement about a pivot axis. The spacing between the pivot axis and the vertical surface is less than the length of the cam between the pivot axis and the free end of the cam. Resilient means are provided for continuously urging the cam toward engagement with the vertical surface, the cam becoming tightly wedged between the pivot axis and the vertical surface upon a downward force being applied to the table top to thereby lock the table top in a desired vertical position in its range of movement. Release means are provided for moving the cam downwardly away from the vertical surface out of engagement with the vertical surface against the urging of the resilient means to facilitate a vertical adjustment of the table top.

Further objects and purposes of this invention will be apparent to persons acquainted with apparatus of this general type upon reading the following specification and inspecting the accompanying drawing.

BRIEF DESCRIPTION OF THE DRAWING

FIG. 1 is a side elevational view of a bedside table embodying the invention;

FIG. 2 is an enlarged sectional view of the upper end portion of the guide post assembly and the table top;

FIG. 3 is an enlarged sectional view of the lower end portion of the guide post assembly;

FIG. 4 is a sectional view taken along the line IV—IV in FIG. 3; and

FIG. 5 is a sectional view similar to FIG. 4 but with the cam having been moved to a release position.

Certain terminology will be used in the following description for convenience in reference only and will not be limiting. The words "up" and "down" will designate directions in the drawing to which reference is made. The words "in" and "out" will refer to directions toward and away from, respectively, the geometric center of the device and designated parts thereof. Such terminology will include the words above specifically mentioned, derivatives thereof and words of similar import.

DETAILED DESCRIPTION

The bedside table 10 (FIG. 1) comprises a base 11 supported on a plurality of wheels 12, a vertical guide post assembly 13 and a horizontal table top 14 secured to the upper end of the vertical guide post assembly 13. The vertical guide post assembly is composed of a vertical tubular member 16 secured to and extending upwardly from one end of the base 11. The upper end of the tubular member 16 is open. A second vertical tubular member 17 is secured to the underside of the horizontal table top 14 adjacent one end thereof and is telescopically mounted on the tubular member 16. In this embodiment, the tubular member 17 is received inside the vertical tubular member 16. The cross-sectional size of the vertical tubular member 17 is slightly smaller than the inside cross-sectional area offered by the vertical tubular member 16 so that the vertical tubular member 17 can slide vertical relative to the vertical tubular member 16 and maintain the table top 14 in a horizontal position throughout its range of movement within the vertical tubular member 17. However, the small clearance will render the table top somewhat unsteady. One of the vertical walls 18 of the vertical tubular member 16 has a hook 19 thereon intermediate the vertically spaced ends thereof. A pair of horizontally spaced recesses 21 are provided in the lower end edge 22 of the vertical tubular member 17. The shaft 23 is received in the recesses 21 and extends across the width of the lower end of the vertical tubular member 17. A constant force spring 24 is mounted on the shaft 23. The constant force spring 24 may be of any conventional type, such as one of the constant force spring elements shown in Vigne U.S. Pat. No. 3,188,986. More specifically, the constant force spring is composed of a coil of flexible resilient metal ribbon 26 which is wound on the shaft 23, the shaft 23 being rotatable in the recesses 21. The internal end of the metal ribbon 26 may be secured to the shaft 23 or merely freely wound thereon and the external end of the ribbon is secured to the hook 19 as illustrated in FIGS. 3 and 4. As the external end of the coil of resilient metal is drawn away from the shaft 23, the ribbon is straightened out as shown in FIGS. 3 and 4 with a portion remaining wound on the shaft 23. In the straightened portion of the metal ribbon, the straightening action is occurring and producing the spring force which tends to pull the external end of the spring back into the coil. Regardless of the length of the straight portion of the ribbon 26, the curved portion on the shaft 23 remains substantially the same length. Thus, the spring force acting to pull the vertical tubular member 17 upward remains the same regardless of the distance between the shaft 23 and the hook 19. As a result, the coil of ribbon 26 mounted on the shaft 23 constitutes a constant force spring which applies a constant force tending to pull the vertical tubular member 17 upwardly and, therefore, the entire table top 14 upwardly. No matter where the table top is, in relation to the base, the force tending to force it upward is constant and an operator or patient need not fear that the force on the table top will change from one elevational position to another. In addition, when the spring force and gravity are closely balanced and a small frictional force is used to overcome the resultant force of the spring and gravity forces, the operator or patient is assured that the resultant force will not vary with the elevation of the table top and, therefore, will not exceed the frictional force at any point throughout its range. In this particular embodiment, the force of the constant force spring is selected to be either equal to or slightly less than the combined weight of the horizontal table top 14 and the vertical tubular member 17.

A releasable locking device 27 is associated between the vertical tubular members 16 and 17. The locking device 27 comprises a cam 28 pivotally secured for movement about the axis of a pin 29 which is secured to and extends between a pair of horizontally spaced walls on the vertical tubular member 17. As a result, the cam 28 is vertically movable with the vertical tubular member 17. The pin 29 is located adjacent one of the other walls of the vertical tubular member 17 and is spaced from a vertical surface 31. The cam 28 is inclined downwardly from the pivot pin 29. The length of the cam 28 between the pivot pin 29 and the free end 32 thereof is greater than the spacing between the pivot pin 29 and the vertical surface 31. A spring 33 is wrapped around the pin 29 and the ends thereof are in engagement with the bottom surface of the cam 28 and on a vertical surface of the vertical tubular member 17 so that the cam 28 is urged upwardly and clockwise about the axis of the pin 29. A socket 34 is provided in the upper surface of the cam 28. A vertical rod 36 extends down through the central portion of the vertical tubular member 17 and the lower end thereof is received in the socket 34. The upper end of the vertical rod 36 extends upwardly above the upper end of the vertical tubular member 17 as best illustrated in FIG. 2.

A lever 37 is pivotally secured to the table top 14 by a pivot pin 39. The lever 37 is composed of a handle 38 on one side of the pivot pin 39 and an engagement plate 41 on the opposite side of the pivot pin 39. The engagement plate 41 is adapted to engage the upper end of the vertical rod 36 when the lever 37 is pivoted about the axis of the pivot pin 39 to push the vertical rod 36 downwardly. The spring 33 acting on the cam 38 tends to bias the cam 28 into engagement with the vertical surface 31 and to thereby support the vertical rod 36 in the position illustrated in FIGS. 2 and 3. In this particular embodiment, a plate member 42 is secured to the upper end of the vertical tubular member 17, which plate member has an opening 43 therein. The upper end of the vertical rod 36 is guided through the opening 43 and, as a result, the vertical rod 36 is maintained in a vertically aligned and centered position within the tubular member 17.

In use, the table top 14 may be moved vertically throughout its range and maintained in a generally horizontal position by simply lifting on the table top 14. The free end 32 of the cam 28 will slide along the vertical surface 31 during vertical movements of the table top 14. However, when the desired elevation is achieved, any attempt to move the table top 14 downwardly will be prevented by the wedging of the cam member 28 between the pivot pin 29 and the vertical surface 31. More specifically, the free end 32 of the cam 28 will frictionally engage the vertical surface 31 to cause a clockwise movement of the cam 28 about the axis of the pivot pin 29. Since the length of the cam 28 between the pivot pin 29 and the free end 32 is greater than the spacing between the pivot pin 29 and the vertical surface 31, it will not be possible to lower the table top 14. In addition, and if an excessive force is applied to the table top 14, the cam 28 will pivot about the axis of the pivot pin 29 until the upper surface of the cam 28 engages an edge 44 provided on the vertical tubular member 17 approximately horizontally aligned with the pivot pin 29. As a result, the table top 14 will be maintained in the desired vertical position. Further, the camming action will cause the telescoping tubes 16 and 17 to become shifted so that the clearance is essentially eliminated or rendered ineffective in creating an unsteadiness in the table top.

When it is desired to lower the table top 14, the handle 38 is first pivoted upwardly about the axis of the pivot pin 39 so that the engagement plate 41 will engage the upper end of the vertical rod 36 to push the vertical rod 36 downwardly against the resistance offered by the spring 33. This action will also serve to disengage the cam 28 from engagement with the vertical surface 31 as illustrated in FIG. 5. Thereafter, the table top 14 can be lowered to the desired level. Upon a release of the handle 38, the spring 33 will cause the cam 28 to again pivot into engagement with the vertical surface 31 so that a continued downward movement of the table top will be prevented.

A pin 46 (FIG. 3) is connected to the side of the cam 28. The pin 46 engages the bottom 47 (FIG. 4) of a notch in the tubular member 47 to limit the downward movement of the cam 28. The pin 46 also engages an edge 48 (FIG. 3) to limit the upward travel of the tubular member 17 and to simultaneously release the cam by urging the cam downwardly.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A bedside table, comprising:

base means including vertical tubular guide means thereon;

a table top having tubular support means thereon telescoped within said vertical guide means to maintain said table top horizontal as its vertical position is varied over a range, the inside surface of said tubular guide means being uniformly spaced from the outside surface of said tubular support means around the entire surface to define a normal clearance therebetween;

a constant force spring connected between said base means and said table top to apply a constant force tending to raise said table top over said range;

releasable locking means adapted to operate between said table top and said base means to lock said table top at one vertical position within said range, said locking means including means defining a vertical surface on said vertical guide means and a cam pivotally secured to said support means for movement about a pivot axis, said cam having an upwardly facing surface thereon, said pivot axis being spaced from said vertical surface a distance less than the length of said cam between said pivot axis and the free end of said cam;

resilient means for continuously urging said cam toward engagement with said vertical surface to generally maintain said upwardly facing surface facing upwardly, said cam becoming tightly wedged between said pivot axis and said vertical surface upon a downward force being applied to said table top to lock said table top in a desired vertical position in its range of movement;

stop means for limiting the downward movement of said cam away from said vertical surface about said pivot axis;

release means for moving said cam downwardly away from said vertical surface out of engagement with said vertical surface against the urging of said resilient means to facilitate a vertical adjustment of said table top, said release means including a handle pivotally secured to said table top and a vertical rod having its lower end freely resting on said upwardly facing surface on said cam and extending upwardly therefrom, said resilient means being sufficiently strong to hold said cam into engagement with said vertical surface and still support said vertical rod, said handle being free of a fixed connection to said vertical rod and being pivotal to engage and push said rod downwardly to push said cam downwardly away from said vertical surface; and guide means for maintaining said rod in vertical alignment.

2. A bedside table according to claim 1, wherein said guide means for said rod includes a socket on said upwardly facing surface of said cam and adapted to receive the lower end of said vertical rod and a hole in a plate secured across the upper end of said tubular support means adapted to receive said vertical rod therethrough.

3. A bedside table according to claim 1, wherein said constant force spring comprises a plurality of convolutions in overlapping engagement and mounted on a shaft secured to said support means on said table top and a straight length extending therefrom to a point of engagement with said vertical guide means on said base means, said plurality of convolutions on said shaft being movable with said support means and said table top throughout its range of movement.

4. A bedside table according to claim 1, wherein said cam in said wedged position renders ineffective said normal clearance between said vertical guide means and said support means so that said table top is maintained steady during use thereof.

5. A bedside table according to claim 4, wherein said vertical guide means and said support means are telescopically related, said normal clearance being defined by the differing dimensions of said vertical guide means and said support means necessary to facilitate a relative adjustment therebetween.

* * * * *